United States Patent [19]

Kusunoki et al.

[11] Patent Number: 4,667,621

[45] Date of Patent: May 26, 1987

[54] SYSTEM FOR PAINTING COMPONENTS OF AN AUTOMOBILE

[75] Inventors: Gen Kusunoki, Nagoya; Akira Meguro, Okazaki; Yasuo Tokushima; Koji Ohta, both of Toyota; Tadashi Kawai, Okazaki; Akihiko Sugata, Toyota, all of Japan

[73] Assignee: Toyota Jidosha Kabushiki Kaisha, Japan

[21] Appl. No.: 779,677

[22] Filed: Sep. 24, 1985

[30] Foreign Application Priority Data

Sep. 28, 1984 [JP] Japan ..... 59-201437

[51] Int. Cl.[4] ..... B05B 15/12

[52] U.S. Cl. ..... 118/687; 118/686; 118/313; 118/320; 118/321; 118/326; 198/358; 198/436; 198/341; 198/356

[58] Field of Search ..... 118/686, 687, 313, 320, 118/321, 326, DIG. 7; 198/358, 436, 341, 356

[56] References Cited

U.S. PATENT DOCUMENTS

| | | | |
|---|---|---|---|
| 2,542,623 | 2/1951 | Cahen | 118/686 X |
| 3,122,231 | 2/1964 | Pence et al. | 198/358 X |
| 3,530,571 | 9/1970 | Perry | 198/358 |
| 4,053,741 | 10/1977 | Ainoya et al. | 198/358 X |

FOREIGN PATENT DOCUMENTS 2728244 1/1979 Fed. Rep. of Germany ..... 118/326

*Primary Examiner*—Shrive P. Beck

*Attorney, Agent, or Firm*—Parkhurst & Oliff

[57] ABSTRACT

A system is disclosed for painting components of an automobile more efficiently and more economically. To achieve the efficient production of painted components, the painting system includes parallel input and output main transfer lines and a plurality of sub transfer lines which are located perpendicular to and between the parallel input and output main transfer lines.

A plurality of input intersections are formed between the input main transfer line and the sub transfer lines, and a plurality of output intersections are formed between the output main transfer line and the sub transfer lines. Each sub transfer line includes a turntable within a painting booth which is located at a central portion of each sub transfer line and a painting device is located at the side of each turntable.

Further, each sub transfer line includes at least an input side waiting position and at least an output side waiting position. A control means is provided for determining when the painting of the component and when the turning of the component is complete. The control means can, therefore, determine when the move the component.

16 Claims, 4 Drawing Figures

SYSTEM FOR PAINTING COMPONENTS OF AN AUTOMOBILE

BACKGROUND OF THE INVENTION

The present invention relates to a system which will paint components of an automobile more efficiently and more economically. More particularly, the present invention relates to improvements in a painting system which has an automatic painting device.

Generally, a painting system for components of an automobile includes a cleaning process for eliminating oil from a surface to be painted, a primer process and a finish process for painting a finishing coat on the component of the automobile being painted.

Normally, one of three painting methods are applicable to the painting system. These include a hand painting method in which the component is painted by a worker, an automatic painting method in which the component is painted by an automatic painting device and a combination painting method in which the component is painted by the automatic painting device and remaining portions of the component are painted by a worker.

Generally the automatic painting method or the combination painting method of a conventional painting system includes a plurality of automatic painting devices and a plurality of work stands which can move along the straight transfer line. The components of the automobiles (e.g. bumper covers which are made of steel or plastic) are painted by the automatic painting devices.

However, when the component is mounted on the work stand and the component is painted by having the work stand move along the transfer line, the component frequently has mottles, thin painted portions and saggings on the painted surface. These mottles, thin painted portions and saggings are caused by vibration (i.e., shaking) of the work stand. To prevent these vibrations, the work stand is usually stopped at each painting station and positioned at the correct painting position. As a result, the conventional painting system requires too much time to paint the components or many painting devices to paint the components.

In another conventional painting system which can paint over 20,000 components per month and which has more than three painting devices for painting a component of an automobile, a plurality of painting devices are aligned on the same side of a straight transfer lin or located at both sides of a straight transfer line. A considerable interval on the transfer line is defined between the painting devices. This is necessary to prevent an arm of one painting device from colliding with an arm of a second painting device, or to prevent components from being painted by different color paints sprayed from different painting devices. This type of painting system therefore requires too much space in a shop.

In these painting systems, the required time period for producing one painted component of an automobile is calculated by the following formula:

$$A=X/Y+Z \quad (1)$$

wherein A is the required time period for completely producing one painted component of the automobile, X is the entire time period required for painting one component of the automobile, Y is the number of the painting devices and Z is the time period required for transferring one component from an initial end of a transfer line of the conventional painting system to a final end of the transfer line.

As the number of the painting devices is increased, the time period required for producing one of the painted components is reduced.

For example, if the entire time period 'X' required for painting one of the component is 120 seconds, the time period 'Z' required for transferring the compnoent is 20 seconds and the number 'Y' of painting devices is 4, this painting system can produce the painted component within 50 seconds. However, if the transfer line is lengthened in proportion to the number of painting devices, then the plant for this painting system is expensive.

To shorten the time period required to produce one of the painted components, five solutions were proposed in private as follows:

The first solution proposed in private was to shorten the time period "Z" required is transfer the component from the initial end of the transfer line to the final end of the transfer line, i.e., to increase the transfer speed of the work stand on which the component is mounted.

The second solution proposed in private was to shorten the entire time period "X" required to paint one of the components of the automobile by improving the efficiency of the spray coating process.

The third solution proposed in private was to increase the speed of movement of the arm of the painting device. This increased the total amount of paint sprayed from the painting device.

The fourth solution proposed in private was to increase the area to be sprayed at one time by the painting device. This also increased the amount of paint sprayed from the painting device.

The fifth solution proposed in private was to increase the number of the painting devices.

However, all of these proposed solutions were inefficient for the following reasons:

In the first proposed solution, the component frequently shifted on the work stand because of the rapid acceleration and deceleration of the word stand. This resulted in the component often being in the wrong position on the work stand. Extra labor was then required to reposition the component on the work stand.

The second proposed solution could not obtain more than 50% efficiency in spray coating according to the painting techniques presently employed.

In the third proposed solution, the normal moving speed of the end of the arm of the painting device depends on both the mechanical speed of the painting device and the electrical control speed of the painting device. A movement of the end of the arm of the painting device of more than 1,000 mm/sec. caused exhaustion of the painting device. This also resulted in inaccurate movement of the end of the arm of the painting device, because the mechanical speed of the painting device could not catch up with the fast electrical control speed of the painting device.

In the fourth proposed solution, an increase in the spray area caused saggings on the painted surface because of variable environmental conditions (e.g. room temperature, viscosity of paint, temperature of the component). Further, it needs extremely expensive facilities to control all of environmental conditions to eliminate this drawback. Furthermore, an uneven surface of the component could not be coated uniformly by spray painting a wide portion of the surface of the component at one time.

The fifth proposed solution is uneconomical because the cost of the plant for the painting system is excessive.

SUMMARY OF THE INVENTION

The present invention was developed in view of the foregoing background and to overcome the foregoing drawbacks. It is accordingly an object of this invention to provide a system for painting components of automobiles which can produce painted components effectively within a short time period using a small number of painting devices.

To effective produce painted components, a painting system is provided which includes parallel input and output main transfer lines and a plurality of sub transfer lines which are located perpendicular to and between the parallel input and output main transfer lines.

A plurality of input intersections are formed between the input main transfer line and the plurality of sub transfer lines, and a plurality of output intersections are formed between the output main transfer line and the plurality of sub transfer lines. Each sub transfer line includes a turntable within a painting booth which is located at a central portion of each sub transfer line and a painting device is located at the side of the turntable.

Furhter, each sub transfer line includes at least an input side waiting position and at least an output side waiting position.

This painting system does not require many painting devices, so that the cost of the facility for the shop can be reduced.

Further, the present painting system does not necessitate a long transfer line, so that the time period for transferring the component can be decreased, and the space for the transfer line can be small.

Thus, the painting system according to the present invention can produce the painted components of the automobiles more efficiently.

BRIEF DESCRIPTION OF THE DRAWINGS

The above objects, features and advantages of the present invention will become more apparent from the description of the invention which follows, taken in conjunction with the accompanying drawings, wherein like reference numerals denote like elements.

DETAILED DESCRIPTION OF THE PREFERRED EMBODIMENT

The present invention will be described in detail with reference to the accompanying drawings which illustrate a preferred embodiment according to the present invention.

Figure 1:
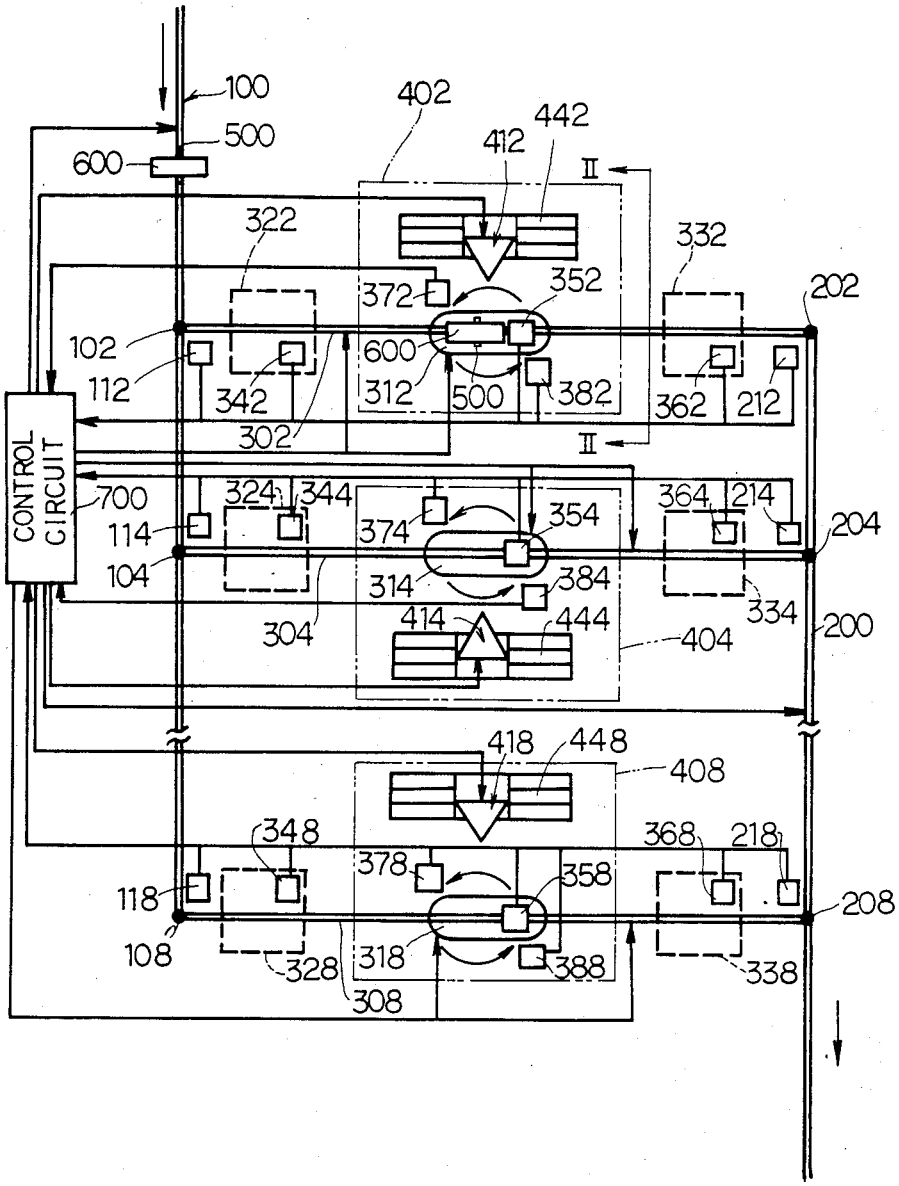
FIG. 1 is a schematic plan view of a plant layout of a finish coating process according to the present invention for painting a surface of a component of an automobile.

Referring to FIG. 1, an input main transfer line 100 is connected to a cleaning process (not shown in drawings) and a primer painting process (not shown in drawings). A surface of a component 600 of an automobile mounted on a work stand 500 is cleaned in the cleaning process and oil is eliminated from the surface of the component. The surface of the component 600 is painted with a primer coat in the primer painting process. The surfce of the component 600 mounted on the work stand 500, which is transferred along the input main transfer line 100, is therefore ready for a finish coat of paint.

Figure 2:
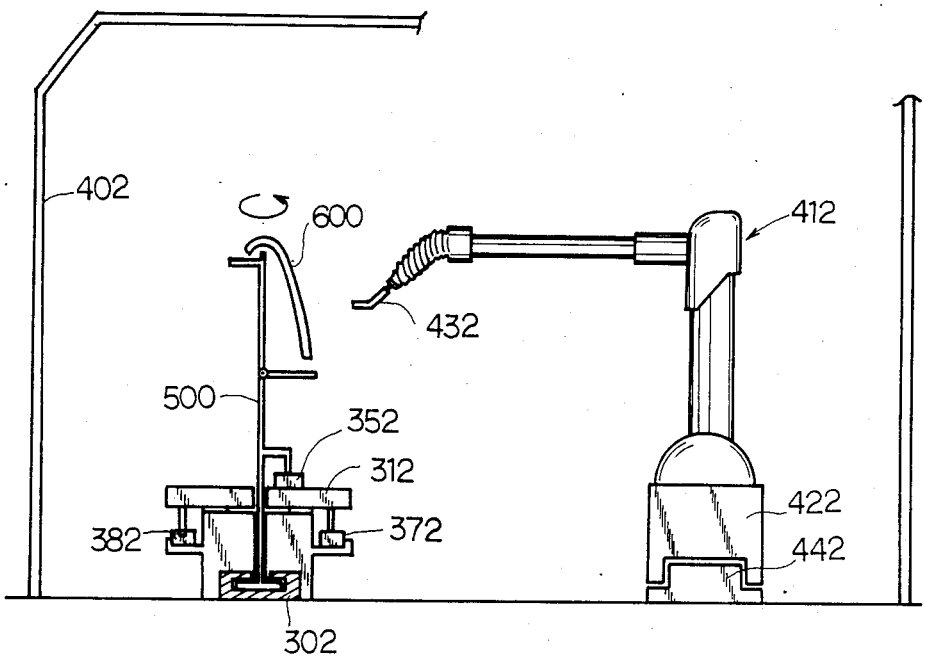
FIG. 2 is an enlarged view of the painting booth, which is seen from the line II—II of FIG. 1 and which includes a partial cross sectional view.

The input main transfer line 100 includes a plurlaity of input intersections 102, 104 and 108 to which a plurality of sub transfer lines 302, 304 and 308 are connected. The plurality of sub transfer lines 302, 304 and 308 are perpendicular to the input main transfer line 100, and each sub transfer line 302, 304 and 308 includes a painting booth 402, 404 or 408 and input side and output side waiting positions 322, 324 or 328 and 332, 334 or 338. As shown in FIG. 2, painting booth 402 includes a turntable 312 which is located at a substantially central position on the sub transfer line 302 and a painting device 412 which is located at a side of the turntable 312. The painting device 412 includes a base portion 422 mounted slidably on a guide rail 442 which is secured to the ground and an arm 432. The arm 432 can be rotated universally and the guide rail 442 which is located in parallel relationship with the first sub transfer line 302. Accordingly, the painting device 412 can move along the guide rail 442 and the arm 432 can approach any portion of the component 600. In the same manner, the painting device 414 or 418 can move along the guide rail 444 or 448. The painting device 412 sprays the paint to the surface of the component 600 from an end of the arm 432 and can paint at least the surface of the component 60 0which faces the painting device 412. Turntable 312 turns the work stand 500 and the component 600 180 degrees so that the painting 412 can paint the remaining surface of the component 600.

First and second limit switches 372 and 382 are disposed in close proximity to the turntable 312. The first limit switch 372 detects when the turntable 312 has made a half turn and when the turntable 312 has made a half turn the first limit switch 372 outputs a first signal to a control circuit 700. The second limit switch 382 detects when the turntable 312 has made a full turn and, when the turntable 312 has made a full turn the second limit switch 382 outputs a second signal to the control circuit 700. In the same manner, the first and second limit switches 374 or 378 and 384 or 388 are disposed in close proximity to turntables 314 or 318 and also function to detect a half turn and a full turn of the turntable 314 or 318.

A third limit switch 352 is located on the turntable 312 and functions to detect when the work stand 500 is positioned correctly on the turntable 312. The third limit switch 352 outputs a third signal to the control circuit 700, when it detects that the work stand 500 is positioned correctly on the turntable 312. The sub transfer lines 302, 304 and 308 are connected to an output main transfer line 200 and form a plurality of output intersections 202, 204 and 208 on the output main transfer line 200. The output main transfer line 200 is parallel to the input main transfer line 100.

A fourth limit switch 112, 114 or 118 is disposed on the input intersection 102, 104 or 108. This fourth limit switch 112, 114 or 118 detects whether the work stand 500 is positioned on each input intersection 102, 104 or 108. The fourth limit switch 112, 114 or 118 outputs a fourth signal to the control circuit 700 when it detects that the work stand 500 is positioned on input intersection 102, 104 or 108.

A fifth switch 342, 344 or 348 is disposed on each input side waiting position 322, 324 or 328 and detects when the work stand 500 is positioned on each input side waiting position 322, 324 or 328. The fifth limit switch 342, 344 or 348 outputs a fifth signal to control circuit 700, when it detects that the work stand 500 is positioned on the input side waiting position 322, 324 or 328. The third limit switch 352, 354 or 358 is disposed on each turntable 312, 314 or 318 and detects when the work stand 500 is positioned on each turntable 312, 314 or 318.

A sixth limit switch 362, 364 or 368 is disposed on each output side waiting position 332, 334 or 338 and detects whether the work stand 500 is positioned on each output side waiting position 332, 334 or 338. The sixth limit switch 362, 364 or 368 outputs a sixth signal to the control circuit 700 when it detects that the work stand 500 is positioned on the output side waiting position 332, 334 or 338.

A seventh limit switch 212, 214 or 218 is disposed one ach output intersection 202, 204 or 208 and detects when the work stand 500 is positioned on each output intersection 202, 204 or 208. The seventh limit switch 212, 214 or 218 outputs a seventh signal to the control circuit 700 when it detects that the work stand 500 is positioned on the output intersection 202, 204 or 208. Further, each sub transfer line 302, 304 or 308 includes a plurality of sectional transfer lines. For example, a first sectional transfer line is located between the intersection 102, 104 or 108 and the input side waiting position 322, 324 or 328, and a second sectional transfer line is located between the input side waiting position 322, 324 or 328 and the turntable 312, 314 or 318.

Figure 3:
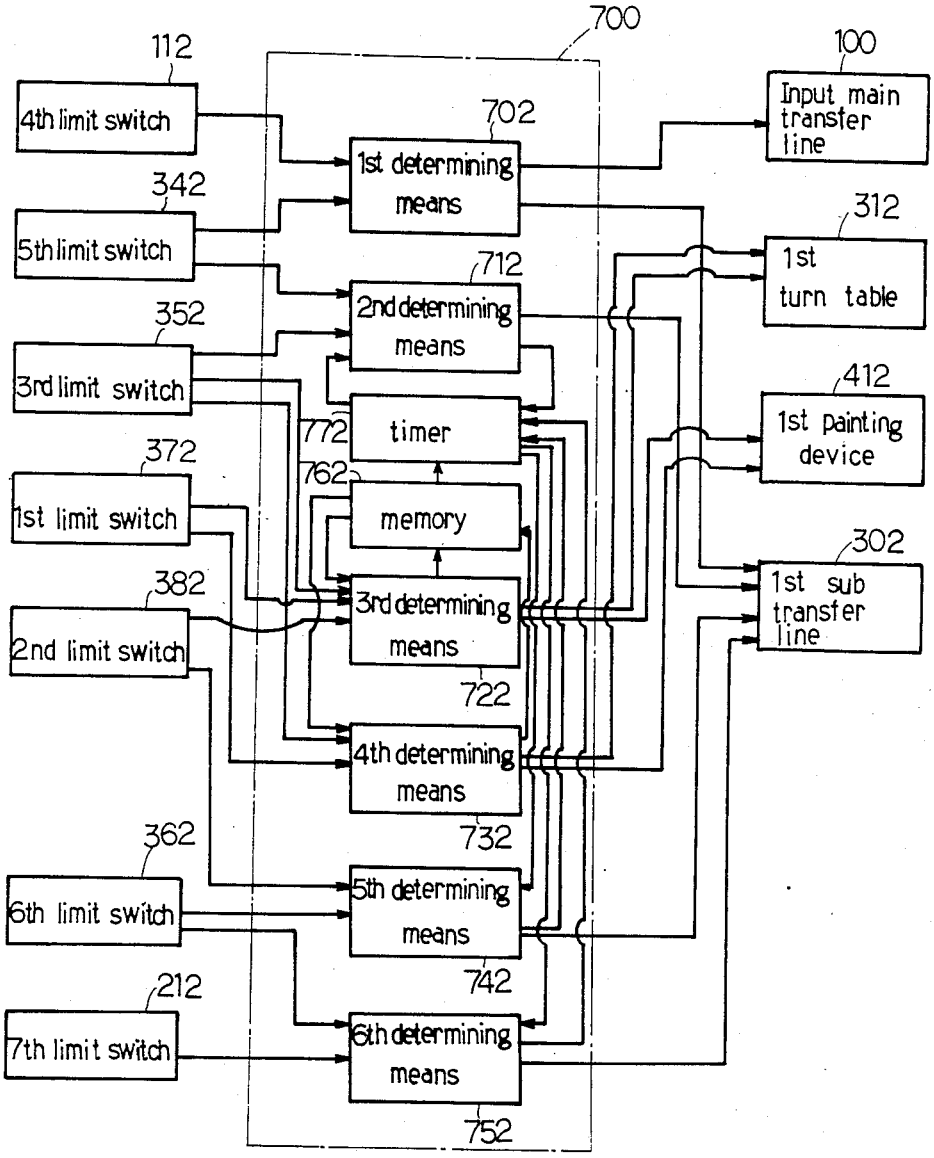
FIG. 3 is a block diagram of the present invention.

Further, as shown in FIG. 3, the control circuit 700 includes a first determining means 702, a second determining means 712, a third determining means 722, a fourth determining means 732, a fifth determining means 742, a sixth determining means 752, a memory 762 and a timer 772.

Figure 4:
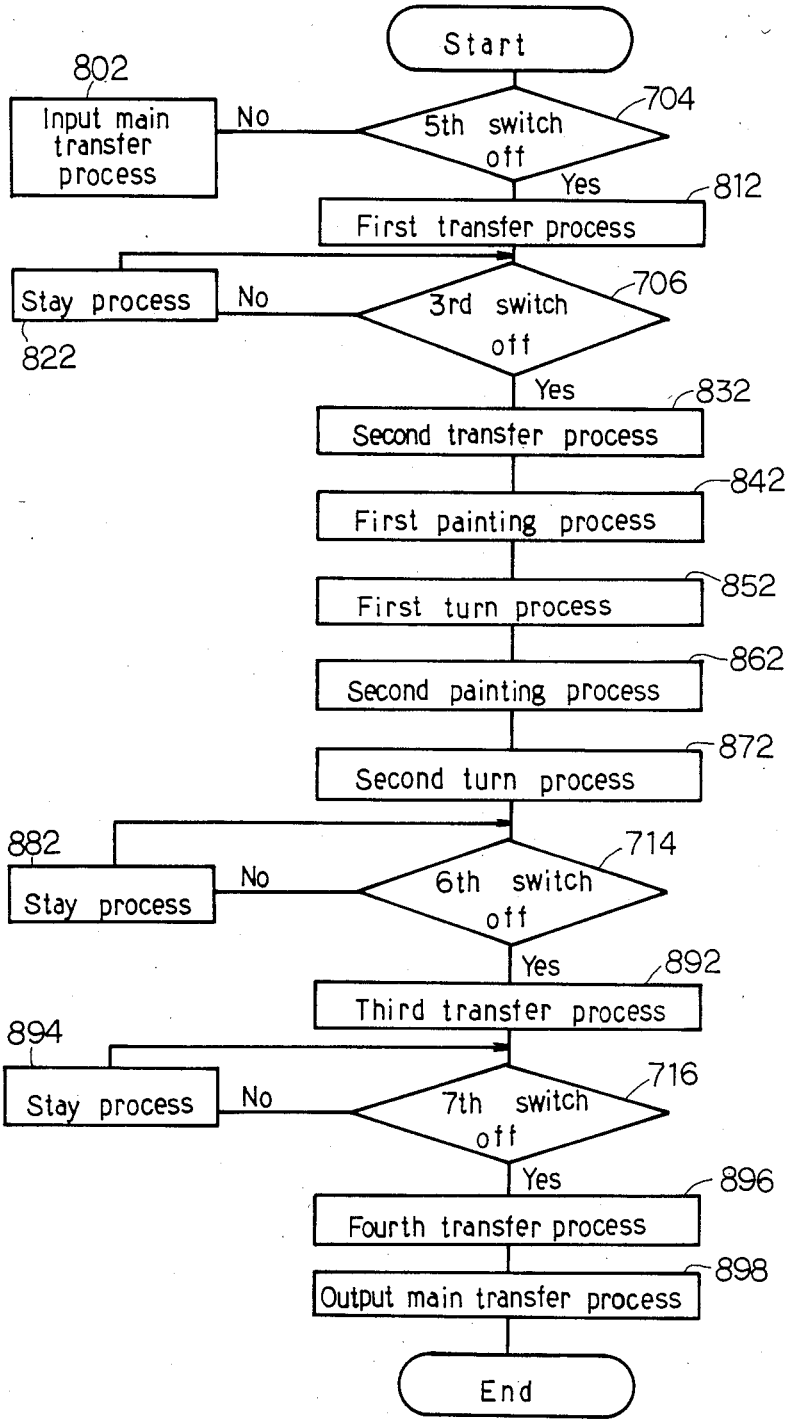
FIG. 4 is a flow chart of the present invention.

Thus, the component 600 of the automobile moves with the work stand 500 as represented by the flow chart of FIG. 4. After the component 600 goes through the cleaning process and the primary painting process, the component 600, which is mounted on the work stand 500, reaches an initial end of the input main transfer line 100, and the component 600 moves along the input main transfer line 100 with the work stand 500, and a first routine for transferring the work stand 500 along the first sub transfer line 302 is initiated. First, step 704 is carried out. When the work stand 500 is located on a first input intersection 102, the fourth limit switch 112 detects that the work stand 500 is positioned on the first input intersection 102 and the fourth limit switch 112 outputs the fourth signal to the first determining means 702 of the control circuit 700. Concurrently, when another work stand is located at the input side waiting position 322, the fifth limit switch 342 outputs the fifth signal to the first determining means 702 of the control circuit 700. Accordingly, the first determining means 702 of the control circuit 700 receives both the fourth and fifth signals and decides to transfer the work stand 500 along the first main transfer line 100 only when a work stand is located on the input side waiting position 322. To transfer the work stand 500, the first determining means 702 of the control circuit 700 receives both the fourth and fifth signals and determines to transfer the work stand 500 along the first main transfer line 100. The first determining means 702 outputs an input main transfer process signal to the first main transfer line 100, and the first main transfer line 100 carries the work stand 500 to the second input intersection 104 in accordance with an input main transfer process 802. Similarly, when the fifth limit switch 114 on the second input side waiting position 324 detects that a work stand is positioned on the second input side waiting position 324, the first determining means 702 of the control circuit 700 outputs the input main transfer process signal to the first main transfer line 100 and the first main transfer line 100 carries the work stand 500 to thrid input intersection 108 in accordance with the input main transfer process 802 for transferring a work stand 500.

When the input side waiting position 322 is empty, e.g., when the fifth limit switch 342 is turned off, the first determining means 702 of the control circuit 700 outputs a first transfer process signal to the first sub transfer line 302, and the first sub transfer line 302 carries the work stand 500 to the input side waiting position 322 in accordance with a first transfer process 812. After the first transfer process 812, step 706 is carried out. Only when a work stand is located on the turntable 312 does the third limit switch 352 of the control circuit 700 output the third signal to the second determining means 712. When the second determining means 712 receives both the fifth and third signals, the second determining means 712 outputs a stay process signal to the first sub transfer line 302, and the first sub transfer line 302 stays the work stand 500 at the input side waiting position 322 in accordance with a stay process 822. Concurrently, the second determining means 712 outputs the stay process signal to the timer 772 and the timer 772 counts down a predetermined time period which is stored in the memory 762. When the timer 772 reaches 'Zero', the stay process 822 ends and step 706 is carried out again. When the turntable 312 is empty, e.g., when the third limit switch 352 is turned off, the second determining means 712 of the control circuit 700 outputs a second transfer process signal to the first sub transfer line 302, and the first sub transfer line 302 carries the work stand 500 to the turntable 312 in accordance with second transfer process 832. After the second transfer process 832, a first painting process 842 is carried out. When the first and second limit swithc 372 and 382 are turned off and the third limit swithc 352 is turned on, the third limit switch 352 outputs a third signal to a third determining means 722 of the control circuit 700 and a third determining means 722 outputs a first painting process signal to a first painting device 412. The first painting device 412 starts painting half of the surface of the component 600 in accordance with the first painting process 842. Concurrently, the third determining means 722 signals the memory 762 to input a first painting pattern program to the third determining means 722 and the third determining means 722 instructs the first painting device 412 to paint half of the surface of the component 600 in accordance with the first painting pattern program. When the arm 432 of the first painting device 412 finishes painting in accordance with the first painting pattern program, the first painting process 842 ends and the third determining means 722 outputs a first turn process signal to the first turntable 312. In response, the first turntable 312 makes a half turn in accordance with a first turn process 852. After the first turn process 852, a second painting process 862 is carried out. When the turntable 312 makes the half turn the first limit switch 372 outputs a first signal to the fourth determining means 732 of the control circuit 700. The fourth determining means 732 outputs a second painting process signal to the first painting device 412 and the first painting device 412 starts painting the other half of the surface of the component 600 in accordance with the second painting process 862. Concurrently, the fourth determining means 732 signals the memory 762 to input a second painting pattern program to the fourth determining means 732 and the fourth determining means 732 instructs the first painting device 412 to paint the other half of the surface of the component 600 in accordance with the second painting pattern program. When the arm 432 of the first painting device 412 finishes painting in accordance with the second painting pattern program, the first painting process 862 ends and the fourth determining means 732 outputs a second turn process signal to the first turntable 312. In response, the first turntable 312 makes a second hald turn in accordance with a second turn process 872. This results in the turntable 312 making a full turn which signals the completion of the finish painting process. Then the second limit switch 382 outputs a second signal.

As it is apparent to those skilled int he art, the painting system can paint the surface of the component 600 in a primer coating process in a similar manner.

Therefore, the painting system according to the present invention does not require a plurality of painting devices to produce a completely painted component of an automobile, namely, one painting device 412 can completely paint the component of the automobile within the painting booth 402.

As is also apparent to those skilled in the art, a flushing device can be included within the painting booth for eliminating oil from the surface of the component before the primer and finish painting processes are carried out. Further, this flushing device can be combined with the painting devices.

After the second turn process 872, step 714 is carried out. When the sixth limit switch 362 detects that another works tand is located on the output side waiting position 332, the sixth limit switch 362 outputs the sixth signal to a fifth determining means 742. Concurrently, the second signal is inputted from the second limit switch 382 to the fifth determining means 742. When the fifth determining means 742 receives both the sixth and second signals, the fifth determining means 742 decides to hold the work stand 500 on the turntable 312. The fifth determining means 742 outputs a stay process signal to the first sub transfer line 302 holds the work stand 500 on the turntable 312 in accordance with a stay process 882. Concurrently, the fifth determining means 742 outputs the stay process signal to the timer 772, and the timer 772 counts down a predetermined time period which is stored in the memory 762. When the timer 772 reaches 'Zero', the stay process 882 ends and step 714 is carried out again.

When the output side waiting position 332 is empty e.g., when the sixth limit switch 362 is turned off, the fifth determining means 742 outputs a third transfer process signal to the first sub transfer line 302. The first sub transfer line 302 transfers the work stand 500 to the output side waiting position 332 in accordance with a third transfer process 892.

After the third transfer process 892, step 716 is carried out. When the seventh limit switch 212 detects that another work stand is located on the first output intersection 202, the seventh limit swithc 212 outputs the seventh signal to a sixth determining means 752. Concurrently, the sixth signal is inputted from the sixth limit switch 362 to the sixth determining means 752.

When the sixth determining means 752 receives both the sixth and seventh signals, the sixth determining means 752 decides to hold the work stand 500 on the output side waiting position 332. The sixth determining means 752 outputs a stay process signal to the first sub transfer line 302 and the first sub transfer line 302 holds the work stand 500 on the output side waiting position 332 in accordance with a stay process 894.

Concurrently, the sixth determining means 752 outputs the stay process signal to the timer 772, and the timer 772 counts down a predetermined time period which is stored in the memory 762. When the timer 772 reaches 'Zero', the stay process 882 ends and step 714 is carried out again.

When the first output intersection 202 is empty, e.g., when the seventh limit switch 212 is turned off, the sixth determining means 752 outputs a fourth transfer process signal to the first sub transfer line 302. The first sub transfer line 302 transfers the work stand 500 to the first output intersection 202 in accordance with a fourth transfer process 896.

After the fourth transfer process 896, an output main transfer process 898 is carried out. In the output main transfer process 898, the work stand 500 is transferred along the output main transfer line 200 to the end of the output main transfer line 200. As a result, the first routine for transferring the work stand ends. When the work stand 500 is moved along the output main transfer line 200 at the same time another work stand is located on the output side waiting position 334 or 338 of the sub transfer line 304 or 308, the control circuit 700 allows main transfer line 200 to work stand 500 along the output main transfer line 200 and outputs the stay process signal to the sub transfer line 304 or 308 to stay the other work stand at the output side waiting position 334 or 338. In other words, the work stand located on the output main transfer line has the priority of movement, while another work stand located on the output side waiting position of the sub transfer line waits to move.

It is apparent for those skilled in the art that a swingable device or a vertically movable device can be used instead of the turntable, and a component can be swung or moved up and down to obtain a better coat of paint on the surface of a component or to achieve more efficient painting process.

It is also apparent for those skilled in the art that a locating device (e.g. a locating pin and a locating hole) may be used to securely stop the work stand at a correct position on the turntable of the sub transfer line.

The time period required to produce a painted component of an automobile according to the present invention is calculated by formula (2) as follows:

$$B=(X+W)/Y \quad (2)$$

wherein B is the time period required to produce one of the painted components of the automobile according to the present invention, X is the entire time period required to paint one of the components of the automobile, Y is the number of painting devices utilized and W is the time period required to transfer the component from the initial end of the transfer line to the final end of the transfer line of the painting system according to the present invention.

To compare the conventional painting system with the painting system according to the present invention, suppose that the entire required time period 'X' for painting one of the component is 120 seconds, the time period 'W' required to transfer the component is 20 seconds (this is the same as the time period 'Z' required to transfer the component mentioned in the background of the invention) and the number of painting devices 'Y' is 4. Then painting system according to the present invention can produce the painted component in 35 seconds while the time period required by the conventional painting system is 50 seconds. The time period according to the present invention, therefore, is a great deal shorter.

While the present invention has been described in its preferred embodiment, it is to be understood that the invention is not limited thereto, and may be otherwise embodied within the scope of the followng claims.

What is claimed is:

1. A system for painting a component of an automobile comprising:

a first main transfer line which is adapted to transfer a work stand, said work stand being adapted to carry a first component;

a second main transfer line which is adapted to transfer said work stand;

a first sub transfer line extending between said first main transfer line and said second main transfer line, said first sub transfer line adapted to transfer said work stand, said first sub transfer line including a first intersection with said first main transfer line and a second intersection with said second main transfer line;

a first painting booth covering an intermediate portion of said first sub transfer line;

a first turning means adapted to turn said first component when said first component is located within said first painting booth;

a first painting means for painting said first component, said painting means being located within said first painting booth, whereby said first turning means is adapted to turn said first component positioned on said work stand so that said first painting means paints an entire surface of said first component;

a second sub transfer line extending between said first main transfer line and said second transfer line, said second sub transfer line adapted to transfer said work stand, said second sub transfer line including a third intersection with said first main transfer line and a fourth intersection with said second main transfer line;

a second painting booth covering an intermediate portion of said second sub transfer line;

a second turning means adapted to turn said component when said component is located within said second painting booth;

a second painting means for painting said first component when said component is located within said second painting booth, whereby said first component mounted on said work stand is painted by said second painting means while a second component is painted by said first painting means;

a first waiting position located on said first sub transfer line, said first waiting position being located between said first painting booth and said first intersection; and a third waiting position located on said second sub transfer line, said third waiting position being located between said second painting booth and said third intersection, whereby said first component mounted on said work stand can stay at one of said first and third waiting positions while a third component is painted by one of said first and second painting means;

wherein each of said first turning means and said second turning means has a first detecting means for detecting a half turn of each of said first turning means and said second turning means, a second detecting means for detecting a full turn of each of said first turning means and said second turning means, and a third detecting means for detecting whether said work stand is positioned on each of said first turning means and said second turning means, said third detecting means being located on each of said first turning means and said second turning means, whereby when said first detecting means of said first turning means or said second turning means detects said half turn of said first turning means or said second turning means, said first detecting means outputs a first signal, and when said second detecting means of said first turning means or said second turning means detects said full turn of said first turning means or said second turning means, said second detecting means outputs a second signal, and when said third detecting means of said first turning means or said second turning means detects said work stand on said first turning means or said second turning means, said third detecting means outputs a third signal.

2. The painting system of claim 1, wherein said first turning means is a first turntable adapted to turn in a horizontal plane and said second turning means is a second turntable adapted to turn in a horizontal plane.

3. The painting system of claim 2, further comprising:

a fourth detecting means for detecting whether said work stand is positioned on said first intersection of said first main transfer line, said fourth detecting means being located on said first intersection and outputting a fourth signal when said fourth detecting means detects said work stand;

a fifth detecting means for detecting whether the work stand is positioned on said first waiting position, said fifth detecting means being located on the first waiting position and outputting fifth signal when said fifth detecting means detects said work stand; and a control circuit comprising a first determining means for receiving said fourth signal and said fifth signal, whereby when said first determining means of said control circuit receives both said fourth signal and said fifth signal, said first determining means determines that said first main transfer line is to transfer the work stand along said first main transfer line, and when said first determining means of said control circuit receives only said fourth signal, the first determining means determines that said first sub transfer line is to transfer the work stand along said first sub transfer line.

4. The painting system of claim 3, wherein the control circuit further comprising a second determining means which receives said fifth signal and said third signal from said fifth detecting means and said third detecting means, whereby when said second determining means of the control circuit receives both said third signal and said fifth signal, said second determining means determines to hold said work stand at said first waiting position, and when said second determining means of said control circuit receives only said fifth signal, said second determining means determines that said first sub transfer line is to transfer said work stand to said first turntable.

5. The painting system of claim 4, wherein said control circuit further comprises a memory means for storing a first pattern and a second pattern of movement of said painting means, whereby said control circuit requests said memory means to input one of the first and second patterns and the memory means ouptuts one of the first and second patterns to the control circuit.

6. The painting system of claim 5, wherein said control circuit further comprises a third determining means for determining whether said painting means is to paint said component which is mounted on said work stand in accordance with said first pattern program stored in said memory means, said third determining means being adapted to receive said first, second and third signals, whereby when said third determining means of said control circuit receives said third signal and does not receive said first signal and said second signal, said third determining means determines that said painting means is to paint said component.

7. The painting system of claim 6, wherein said third determining means determines that said turntable is to make said half turn when said painting means finishes movement in accordance with said first pattern.

8. The painting system of claim 7, wherein said control circuit further comprises a fourth determining means for determining whether said painting means is to paint said component which is mounted on said work stand in accordance with said second pattern program stored in said memory, said fourth determining means being adapted to receive said first and third signals, whereby when said fourth determining means of said control circuit receives said first signal and said third signal from said first detecting means and said third detecting means, said fourth detecting means determines that said painting means is to paint said component.

9. The painting system of claim 8, wherein said fourth determining means determines that said turntable is to make a second half turn when said painting means finishes movement in accordance with said second pattern.

10. The painting system of claim 9, further comprising:

a second waiting position being located on said first sub transfer line, said second waiting position being located between said first painting booth and said second intersection; and a fourth waiting position being located on said second sub transfer line said fourth waiting position being located between said second painting booth and said fourth intersection.

11. The painting system of claim 10, further comprising a sixth detecting means for detecting whether said work stand is positioned on said second waiting position, said sixth detecting means being located on said second waiting position, said sixth detecting means being located on said second waiting position and outputting a sixth signal when said sixth detecting means detects said work stand.

12. The painting system of claim 11, wherein said control circuit further comprises a fifth determining means for determining whether said first sub transfer line is to transfer said work stand to said second waiting position, said fifth determining means being adapted to receive said sixth signal and said second signal from said sixth detecting means and said second detecting means, whereby when said fifth determining means receives said sixth signal from said sixth detecting means and said painting means finishes movement in accordance with the second pattern, said fifth determining means determines that said first sub transfer line is to hold said work stand on said first turntable, and when said fifth determining means does not receive said sixth signal, said fifth determining means determines that said first sub transfer line is to transfer the works tand to the second waiting position.

13. The painting system of claim 12, further comprising a seventh detecting means for detecting when said work stand is positioned on said second intersection, said seventh detecting means being located on said second intersection and outputting a seventh detecting means outputs a seventh signal when the seventh detecting means detects said work stand.

14. The painting system of claim 13, wherein said control circuit further comprises a sixth determining means for determining whether said first sub transfer line is to transfer said work stand to said second intersection, said sixth determining means being adapted to receive said seventh signal from the seventh detecting means and said sixth signal from said sixth detecting means, whereby when said sixth determining means receives both said seventh signal and said sixth signal, said sixth determining means determines that said first sub transfer line is to hold said work stand in said second waiting position, and when said sixth determining means receives only said sixth signal, said sixth determining means determines that said first sub transfer line is to transfer said work stand to said second intersection.

15. A system for painting a component of an automobile comprising:

a first main transfer line which is adapted to transfer a work stand, said work stand being adapted to carry a component;

a second main transfer line which is adapted to transfer said work stand;

a first sub transfer line extending between said first main transfer line and said second main transfer line, said first sub transfer line adapted to transfer said work stand, said first sub transfer line including a first intersection with said first main transfer line and a second intersection with said second main transfer line;

a first painting booth covering an intermediate portion of said first sub transfer line;

a firth turntable adapted to turn said first component in a horizontal plane when said component is located within said first painting booth;

a second sub transfer line extending between said first main transfer line and said second main transfer line, said second sub transfer line being adapted to transfer said work stand, said second sub transfer line including a third intersection with said first maint transfer line and a fourth intersection with said second main transfer line;

a second painting booth covering an intermediate portion of said second sub transfer line;

a second turntable adapted to turn said component in a horizontal plane when said component is located within said painting booth;

a second painting means, for painting said component when said component is located within said second painting booth, a first waiting position located on said first sub transfer line, said first waiting position being located between said first painting booth and said first intersection; and a third waiting position located on said second sub transfer line, said third waiting position being located between said second painting booth and said third intersection, wherein each of said first turntable and said second turntable has a first detecting means for detecting a half turn of each of said first turntable and said second turntable, a second detecting means for detecting a full turn of each of said first turntable and said second turntable, and a third detecting means for detecting whether said work stand is positioned on each of said first turntable and said second turntable, said third detecting means being located on each of said first turntable and said second turntable, whereby when said first detecting means of said first turntable or said second turntable detects said half turn of said first turntable or said second turntable, said first detecting means outputs a first signal, and when said second detecting means of said first turntable or said second turntable detects said full turn of said first turntable or said second turntable, said second detecting means outputs a second signal, and when said third detecting means of said first turntable or said second turntable detects said work stand on said first turntable or said second turntable, said third detecting means outputs a third signal.

16. A system for painting a component of an automobile comprising:

a first main transfer line which is adapted to transfer a work stand, said work stand being adapted to carry a first component;

a second main transfer line which is adapted to transfer said work stand;

a first sub transfer line extending between said first main transfer line and said second main transfer line, said first sub transfer line adapted to transfer said work stand, said first sub transfer line including a first intersection with said first main transfer line and a second intersection with said second main transfer line;

a first painting booth covering an intermediate portion of said first sub transfer line;

a first turntable adapted to turn said first component in a horizontal plane when said first component is located within said first painting booth;

a first painting means for painting said first component, said first painting means being located within said first painting booth, whereby said first turning means is adapted to turn said first component positioned on said work stand such that said first painting means paints an entire surface of said first component;

a second sub transfer line extending between said first main transfer line and said second main transfer line, said second sub transfer line being adapted to transfer said work stand, said second sub transfer line including a third intersection with said first main transfer line and a fourth intersection with said second main transfer line;

a second painting booth covering an intermediate portion of said second sub transfer line;

a second turntable adapted to turn said component in a horizontal plane when said component is located within said second painting booth;

a second painting means for painting said first component when said first component is located within said second painting booth, whereby said first component mounted on said work stand is painted by said second painting means while a second component is painted by said first painting means;

a first waiting position located on said first sub transfer line, said first waiting position being located between said first painting booth and said first intersection;

a third waiting position located on said second sub transfer line, said third waiting position being located between said second painting booth and said third intersection, whereby said first component mounted on said work stand can remain at one of said first and third waiting positions while a third component is painted by one of said first and second painting means;

wherein each of said first turntable and said second turntable has a first detecting means for detecting a half turn of each of said first turntable and said second turntable, a second detecting means for detecting a full turn of each of said first turntable and said second turntable, and a third detecting means for detecting whether said work stand is positioned on each of said first turntable and said second turntable, said third detecting means being located on each of said first turntable and said second turntable, whereby when sait first detecting means of said first turntable or said second turntable detects said half turn of said first turntable or said second turntable, said first detecting means outputs a first signal, and when said second detecting means of said first turntable or said second turntable detects said full turn of said first turntable or said second turntable, said second detecting means outputs a second signal, and when said third detecting means of said first turntable or said second turntable detects said work stand on said first turntable or said second turntable, said third detecting means outputs a third signal.

* * * * *